US007161538B2

(12) United States Patent
Zhang et al.

(10) Patent No.: US 7,161,538 B2
(45) Date of Patent: Jan. 9, 2007

(54) MULTIPLE BAND ANTENNA AND ANTENNA ASSEMBLY

(75) Inventors: Zhijun Zhang, San Diego, CA (US); Jean-Christophe Langer, San Diego, CA (US); Rob Sutter, DeKalb, IL (US); Tony Kfoury, Lisle, IL (US)

(73) Assignee: Amphenol-T&M Antennas, Vernon Hills, IL (US)

( * ) Notice: Subject to any disclaimer, the term of this patent is extended or adjusted under 35 U.S.C. 154(b) by 0 days.

(21) Appl. No.: 11/136,094

(22) Filed: May 24, 2005

(65) Prior Publication Data

US 2005/0275594 A1 Dec. 15, 2005

Related U.S. Application Data

(60) Provisional application No. 60/573,875, filed on May 24, 2004.

(51) Int. Cl.
*H01Q 1/38* (2006.01)
*H01Q 9/16* (2006.01)

(52) U.S. Cl. ..... 343/700 MS; 343/793; 343/795; 343/895

(58) Field of Classification Search ..... 343/700 MS, 343/702, 793, 795, 895
See application file for complete search history.

(56) References Cited

U.S. PATENT DOCUMENTS 3,774,221 A 11/1973 Francis
3,828,353 A 8/1974 Majkrzak et al.
3,902,178 A 8/1975 Majkrzak
4,074,271 A 2/1978 Sakuma
4,097,867 A 6/1978 Eroncig
4,125,840 A 11/1978 Cassel
4,435,713 A 3/1984 Gasparaitis et al.
4,435,716 A 3/1984 Zandbergen
4,914,450 A 4/1990 Dilley et al.
5,057,849 A 10/1991 Dörrie et al.
5,218,369 A 6/1993 Jennings
5,226,221 A 7/1993 Kilgore
5,271,684 A 12/1993 Phillips
5,341,149 A 8/1994 Valimaa et al.
5,428,364 A 6/1995 Lee et al.
5,559,522 A 9/1996 Seitz
5,576,720 A 11/1996 Gorenz, Jr. et al.
5,603,630 A 2/1997 Villain
5,648,788 A 7/1997 Bumsted
5,650,789 A 7/1997 Elliott et al.
5,661,495 A 8/1997 Saldell
5,686,927 A 11/1997 Simmons
5,836,072 A 11/1998 Sullivan et al.

(Continued)

OTHER PUBLICATIONS

Chia-Ching Lin, Gwo-Yun Lee and Kin-Lu Wong, "Surface-Mount Dual-Loop Antenna for 2.4/5 GHz WLAN Operation", Electronics Letters, Sep. 4, 2003, vol. 39, No. 18, pp. 1302-1304.

(Continued)

*Primary Examiner*—Trinh Vo Dinh
(74) *Attorney, Agent, or Firm*—Greer, Burns & Crain, Ltd.

(57) ABSTRACT

Multiple band antenna for mounting to a portable device. The antenna comprises a piece of conductive metal including a half-bowtie portion shaped to define a monopole and folded to provide a plurality of planar surfaces together generally enclosing a volume. A flexible spring contact extends from the half-bowtie portion. The spring contact is configured for engaging a contact of the portable device.

21 Claims, 14 Drawing Sheets

U.S. PATENT DOCUMENTS 5,892,480 A 4/1999 Killen
5,986,619 A 11/1999 Grybos et al.
6,046,699 A 4/2000 Elliott et al.
6,062,912 A 5/2000 Witczak et al.
6,064,343 A 5/2000 Crowley et al.
6,091,368 A 7/2000 Mitchell et al.
6,140,966 A * 10/2000 Pankinaho ..... 343/700 MS
6,140,973 A 10/2000 Annamaa et al.
6,163,300 A 12/2000 Ishikawa et al.
6,166,695 A 12/2000 Witczak et al.
6,198,440 B1 3/2001 Ha et al.
6,198,448 B1 3/2001 Suzuki et al.
6,204,825 B1 * 3/2001 Wilz ..... 343/841
6,219,902 B1 4/2001 Memmen et al.
6,281,846 B1 * 8/2001 Puente Baliarda et al. ..... 343/700 MS
6,339,409 B1 * 1/2002 Warnagiris ..... 343/895
6,369,775 B1 4/2002 Moore et al.
6,414,647 B1 7/2002 Lee
6,486,837 B1 * 11/2002 Spiegel et al. ..... 343/702
6,552,692 B1 4/2003 Zeilinger et al.
6,567,053 B1 * 5/2003 Yablonovitch et al. ..... 343/767
6,621,464 B1 9/2003 Fang et al.
6,624,793 B1 9/2003 Su et al.
6,650,298 B1 * 11/2003 Abbasi et al. ..... 343/702
6,753,814 B1 6/2004 Killen et al.
6,774,849 B1 8/2004 Umehara et al.
6,842,142 B1 * 1/2005 Takesako et al. .... 343/700 MS
6,917,334 B1 * 7/2005 Chen ..... 343/700 MS
2004/0095280 A1 5/2004 Poilasne et al.
2005/0146467 A1 7/2005 He et al.
2005/0280584 A1 * 12/2005 Aron et al. ..... 343/702
2006/0071873 A1 * 4/2006 Warnagiris ..... 343/895

OTHER PUBLICATIONS

Young-Ho Suh and Kai Chang, "Low Cost Microstrip-Fed Dual Frequency Printed Dipole Antenna for Wireless Communications", Electronics Letters, Jul. 6, 2000, vol. 36, No. 14, pp. 1177-1178.

Chih-Ming Su, Hong-Twu Chen and Kin-Lu Wong, "Printed Dual-Band Dipole Antenna with U-slotted Arms for 2.4/5.2 GHz WLAN Operation", Electronics Letters, Oct. 24, 2002, vol. 38, No. 22; pp. 1308-1309.

Tai-Lee Chen, "Multi-Band Printed Sleeve Dipole Antenna", Electronics Letters, Jan. 9, 2003, vol. 39, No. 1, pp. 14-15.

D. Nashaat, H. A. Elsadek and H. Ghali, "Dual-band reduced size PIFA antenna with U-slot for bluetooth and WLAN applications," IEEE Antennas and Propogation Society International Symposium, 2003, vol. 2, pp. 962-965.

Y. L. Kuo and K.L. Wong, "Printed double-T monopole antenna for2.4/5.2 GHz dual-band WLAN operations," IEEE transactions and propogation, vol. 51, n 9, pp. 2187-2192, Sep. 2003.

* cited by examiner

MULTIPLE BAND ANTENNA AND ANTENNA ASSEMBLY

PRIORITY CLAIM

The present application claims the benefit of U.S. Provisional Application Ser. No. 60/573,875, filed May 24, 2004, under 35 U.S.C. § 119.

BACKGROUND OF THE INVENTION

A field of the present invention is antennas for portable devices.

Antennas currently being used for portable devices such as, but not limited to, portable communication devices, portable computing devices (including hand held computers and personal digital assistants), and portable computers, are optimized by design for reception of specific radio frequency bands. For example, particular portable devices may include GSM antennas (appr. range 824–960 MHz), GPS antennas (1575 MHz), DCS antennas (1710–1880 MHz), PCS antennas (1850–1990 MHz), 802.11b antennas (2.4–2.48 GHz), and/or 802.11a/g antennas (5.15–5.85 GHz). Still others may provide antennas in 3G range, for example, or in other frequency bands.

However, because antennas for such devices are tailored to particular bands, reception in more than one or two bands typically requires multiple mounted antennas. This in turn requires valuable real estate on or in a portable device. It is desirable to make portable devices sufficiently small for practical use, while providing a sufficiently rugged design to allow extended use of the device.

SUMMARY OF THE INVENTION

Preferred embodiments of the present invention provide, among other things, a multiple band antenna for mounting to a portable device. The antenna comprises a piece of conductive metal including a half-bowtie portion shaped to define a monopole and folded to provide a plurality of planar surfaces together generally enclosing a volume. A flexible spring contact extends from the half-bowtie portion. The spring contact is configured for engaging a contact of the portable device.

DETAILED DESCRIPTION OF PREFERRED EMBODIMENTS

Figure 1:
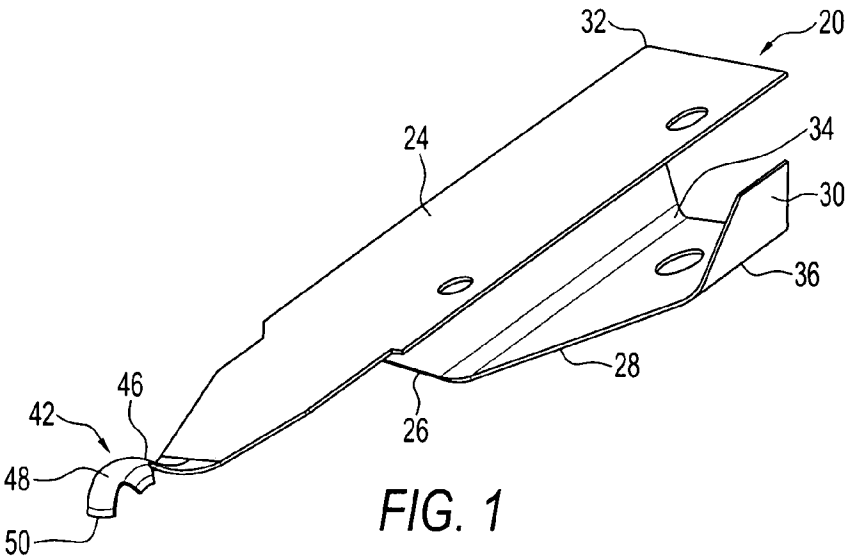
FIG. 1 is a perspective view of a multiple band antenna.
Figure 2:
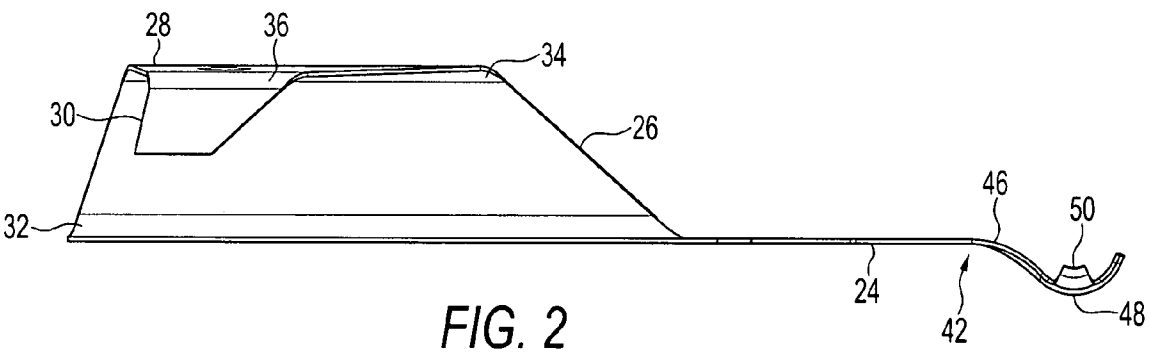
FIG. 2 is a side elevation view of the multiple band antenna of FIG. 1.

Preferred embodiments of the present invention include a multiple band antenna capable of reception across several, e.g., six or seven, bands. A preferred multiple band antenna adds a relatively small volume to a portable device. For example, a preferred multiple band antenna can be implemented as a short stubby antenna extending from a portable device.

Antenna reception in devices prior to the present invention typically has been based on a monopole principle, where an extended antenna provides a half-dipole and a ground plane such as a printed circuit board (PCB) of the mobile electronic device serves as the other half-dipole.

Preferred embodiments of the present invention include a multiple band antenna for a portable device. The antenna includes a piece of conductive metal including a half-bowtie portion shaped to define a monopole. A PCB provides the other half-dipole. Bowtie antennas have been used for television consoles and other typically stationary products, but they usually are not used in portable devices. Further, though a bowtie typically has been employed as a dipole antenna having symmetric ends, the half-bowtie portion of present preferred embodiments operates as a monopole antenna. A flexible spring contact for engaging a contact of the portable device extends from the half-bowtie portion.

The half-bowtie portion is folded to provide a plurality of planar surfaces generally enclosing a volume, and preferably is folded about a base to conserve area and/or volume real estate of the portable device. This folded shape provides a more rigid mechanical structure for a stubby antenna, while retaining benefits of multiple band reception.

The preferred multiple band antenna and base are part of an antenna assembly coupled to other parts of the portable device, including the PCB. An overmold preferably covers part of the base and the multiple band antenna. To maintain electrical contact with the PCB, the flexible spring contact is exposed (that is, not covered by the overmold). In an exemplary embodiment, the PCB includes a rigid, C-shaped clip to provide a sufficient electrical contact area with the spring contact, while reducing or minimizing a circuit path between the spring contact and a signal splitter (diplexer) of the PCB.

It is desired in the art to provide portable devices having reception capabilities across broad portions of the electromagnetic spectrum. For example, GSM, GPS, DCS, PCS, 802.11a, and 802.11b are common frequency bands for use in current portable devices. Additional bands may become desirable in the future.

However, conventional antennas are not able to receive signals in most of these bands in a single device without the use of multiple mounted antennas. One problem with using multiple mounted antennas is that portable devices need to be truly portable; that is, portable designs naturally impose constraints on volume and area real estate. Increasing the number of mounted antennas or increasing the size of individual antennas tends to increase the overall size, including area and volume, of such portable devices. This is an undesirable result.

Another problem is that multiple antennas may introduce challenges as to integrating such antennas into the device, and additional antennas add to design and manufacturing costs for a device. Accordingly, it is desired to provide an antenna and/or antenna assembly for a portable device that enables reception across various bands, while also providing a relatively small volume and/or area in terms of device real estate.

One antenna type used in portable devices presently is a flex antenna. Such flex antennas typically include a number of traces, where individual traces allow reception of a particular band. However, traces for each individual band need to be separated from one another for increased bandwidth. A significant number of bands (for example, six) thus increases the size of such an antenna, and accordingly increases real estate for the portable device. If the traces are not sufficiently separated from one another, low bandwidth reception results.

The present inventors have discovered that the use of a single-piece antenna made of a preferably stamped, conductive material is capable of providing multiple band reception. Such an antenna has the capability of providing a greater number of bands than a conventional flex antenna used for portable devices. According to a preferred embodiment of the present invention, the individual antenna used has a substantially triangular shape, providing essentially a half bowtie antenna.

Before the present invention, bowtie antennas have been used for applications in a generally non-portable context. For example, televisions have been known to employ bowtie antennas for larger bandwidth reception. However, a preferred embodiment of the present invention implements particular capabilities of a bowtie antenna for use in a portable device, while limiting the real estate required by the portable antenna.

In such conventional bowtie antennas, the bowtie antennas have been flat. However, according to a preferred embodiment of the present invention, a half-bowtie is folded to provide a relatively small volume while providing a sturdy antenna assembly. The present inventors have found that use of a folded antenna does not detract significantly from the reception goals of many portable devices. Such an antenna, in combination with a resonating PCB, is capable of signal reception in widely varying bands, preferably including those named above, and others.

Conventional bowtie antennas are used typically for low band reception. However, the multiple band antenna according to a preferred embodiment of the present invention allows reception of both low and high band signals.

Figure 3:
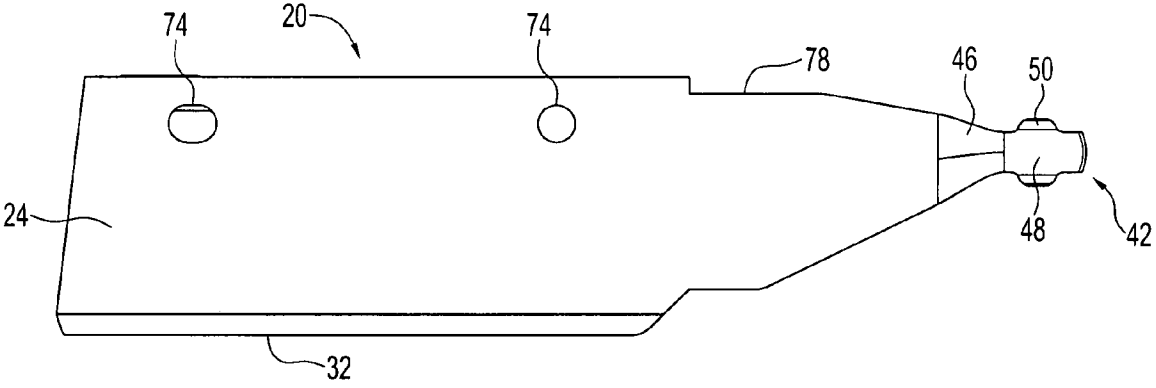
FIG. 3 is a top plan view of the multiple band antenna of FIG. 1.
Figure 4:
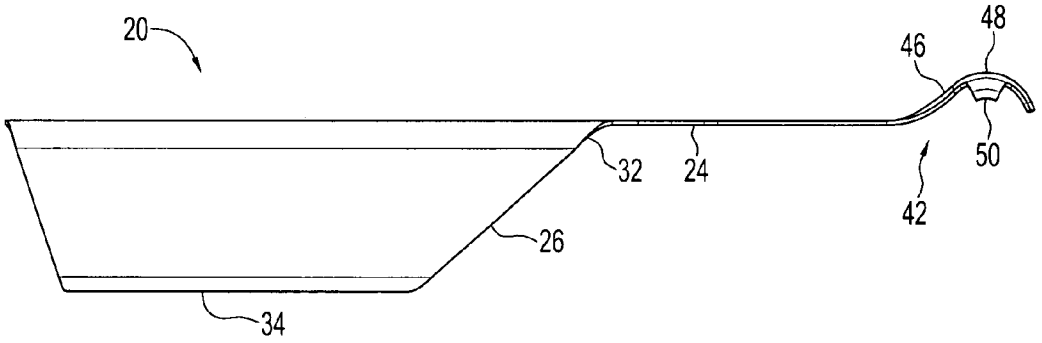
FIG. 4 is a side elevation view of the multiple band antenna of FIG. 1, inverted.

Referring now to FIGS. 1–6, an exemplary multiple band antenna 20 for a portable device such as a mobile communication device, when folded, defines a first planar surface 24, a second planar surface 26, a third planar surface 28, and a fourth planar surface 30 (in decreasing order of size). The multiple band antenna 20 is generally formed by, preferably, a stainless steel plated (selectively or completely) by gold and nickel sulfamate, and stamped to form a desired shape. The planar surfaces, 24, 26, 28, and 30 are formed by first, second and third folds 32, 34, and 36, thus generally enclosing a volume by the folded antenna 20. As is most clearly seen in FIG. 6, the enclosed volume in an exemplary embodiment is generally trapezoidal in shape, and is tapered from front to back. However, this particular shape is not required for a folded antenna, and other shapes are possible, for example, for space or mechanical consideration and/or for aesthetic purposes. As shown in FIGS. 1 and 3, the first planar surface 24 extends along the full length of the multiple band antenna 20 and along most of the covered portion of a base 40, which mechanically supports the multiple band antenna.

A flexible spring contact 42 of the multiple band antenna 20 extends from a bottom end of the antenna (in the orientation shown in FIG. 1) for electrically connecting to a printed circuit board (PCB) of the mobile communication device. The spring contact 42 may be integrally formed with the remainder of the antenna 20, or it may be a separate piece mechanically and electrically coupled to the remainder of the antenna. As most clearly seen in FIGS. 2–4, the exemplary spring contact 42 contains a generally rounded, arced surface 46 forming a rounded portion 48 at its peak. The rounded portion 48 contains three small flaps 50 preferably formed by precisely crimping the rounded portion 48 of the spring contact 42. This structure is preferred, not required, for the spring contact 42, though it provides certain mechanical benefits, particularly for maintaining contact with the PCB and for rigidity. The rounded portion 48 engages the PCB for transmitting signals from the antenna 20.

Figure 5:
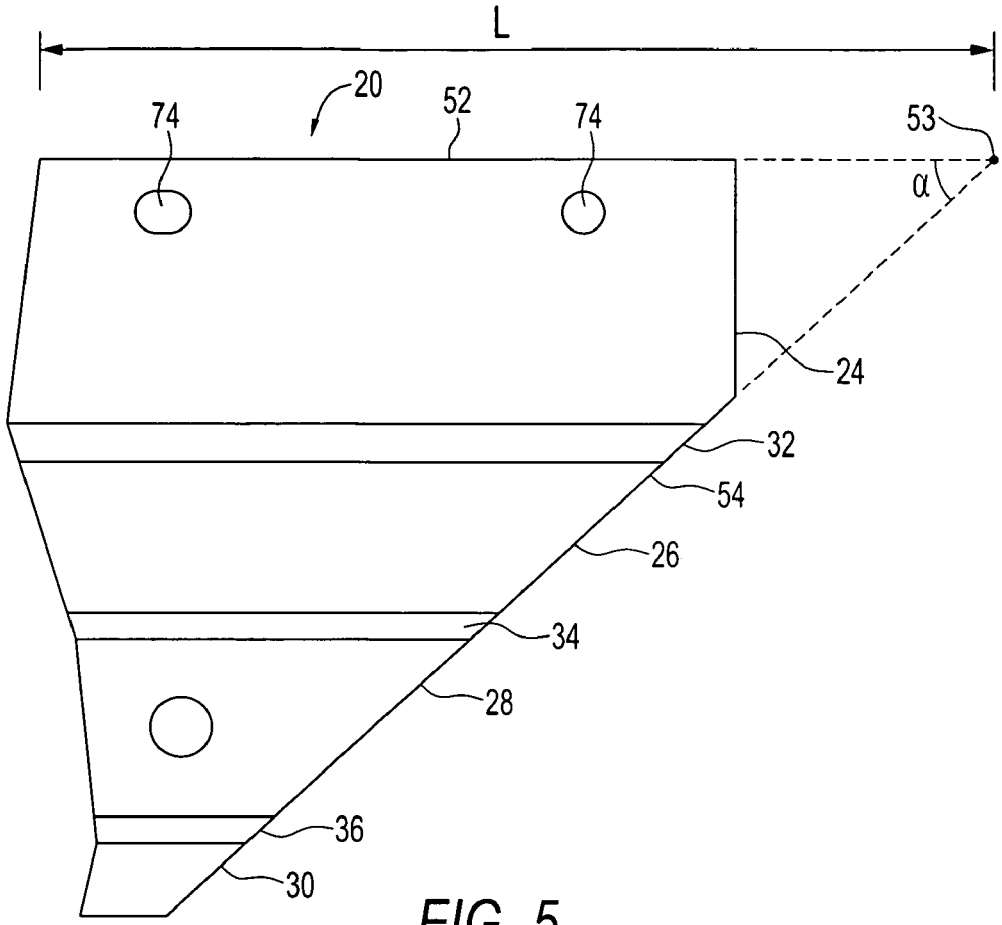
FIG. 5 is a top plan view of a portion of a multiple band antenna, unfolded to a flat plane, with a spring contact omitted for clarity.
Figure 6:
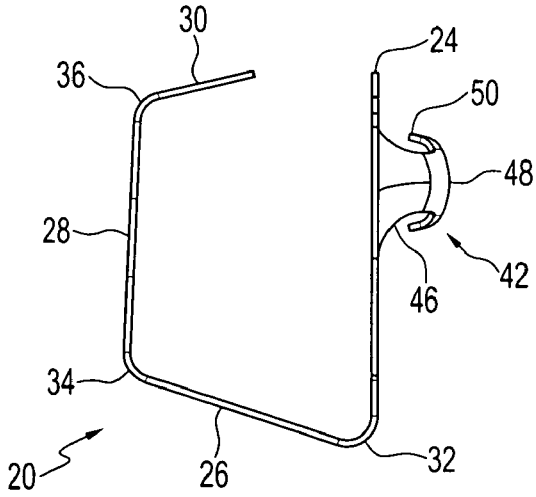
FIG. 6 is an end view of the multiple band antenna of FIG. 1.
Figure 7:
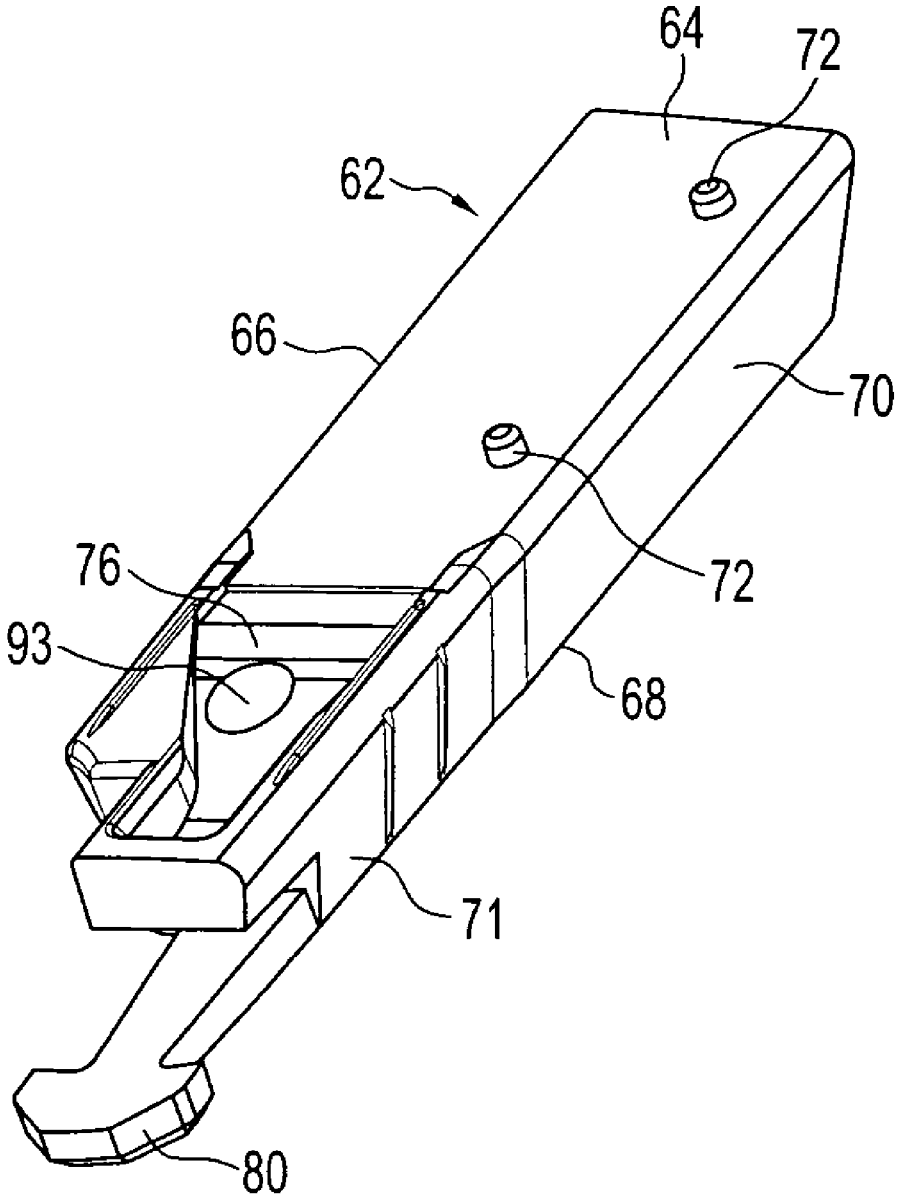
FIG. 7 is a perspective view of an antenna base.
Figure 8:
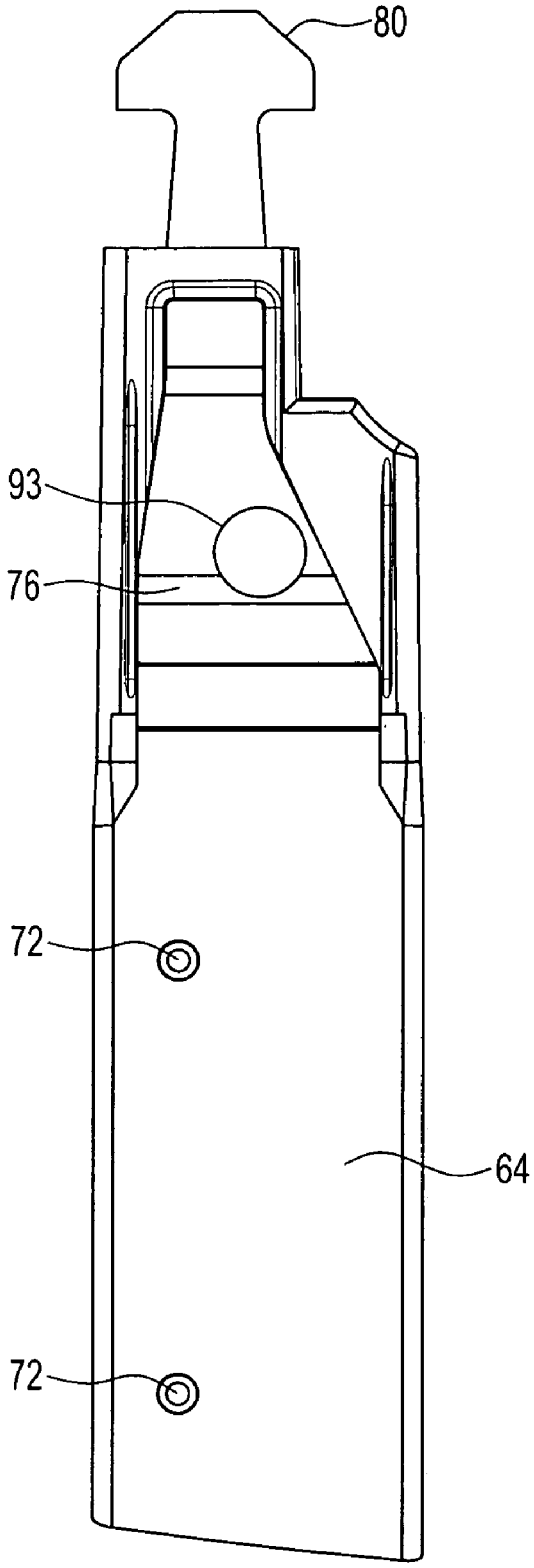
FIG. 8 is a top plan view of the antenna base of FIG. 7.
Figure 9:
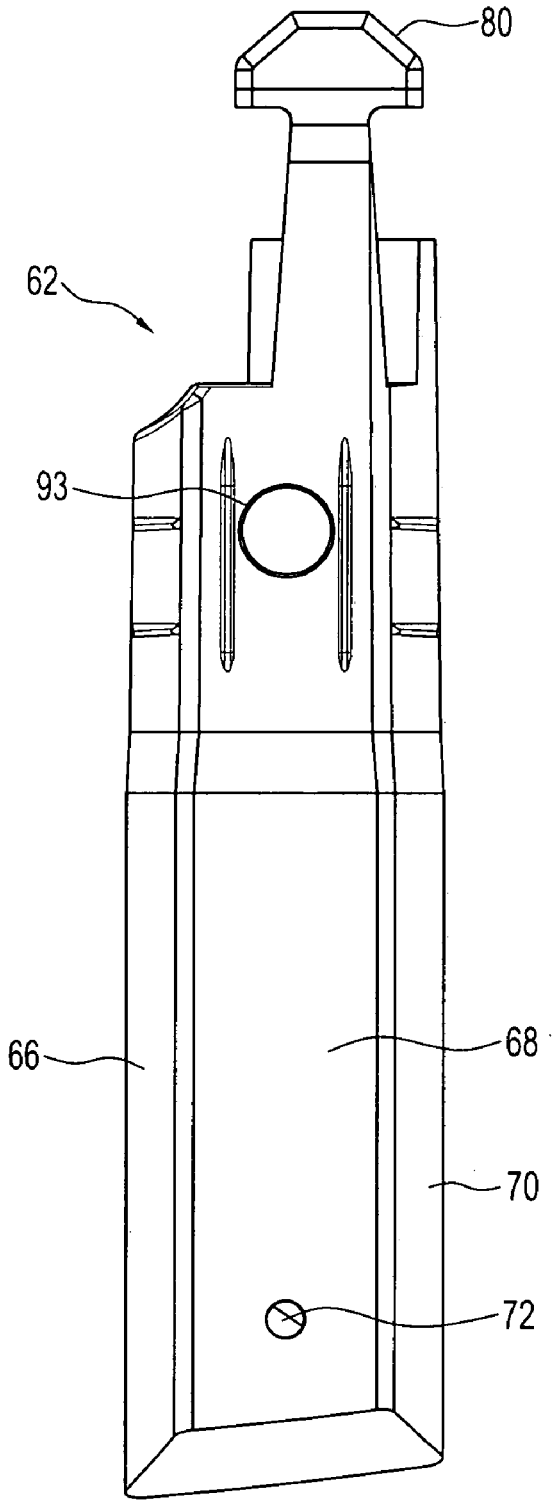
FIG. 9 is a bottom plan view of the antenna base of FIG. 7.
Figure 10:
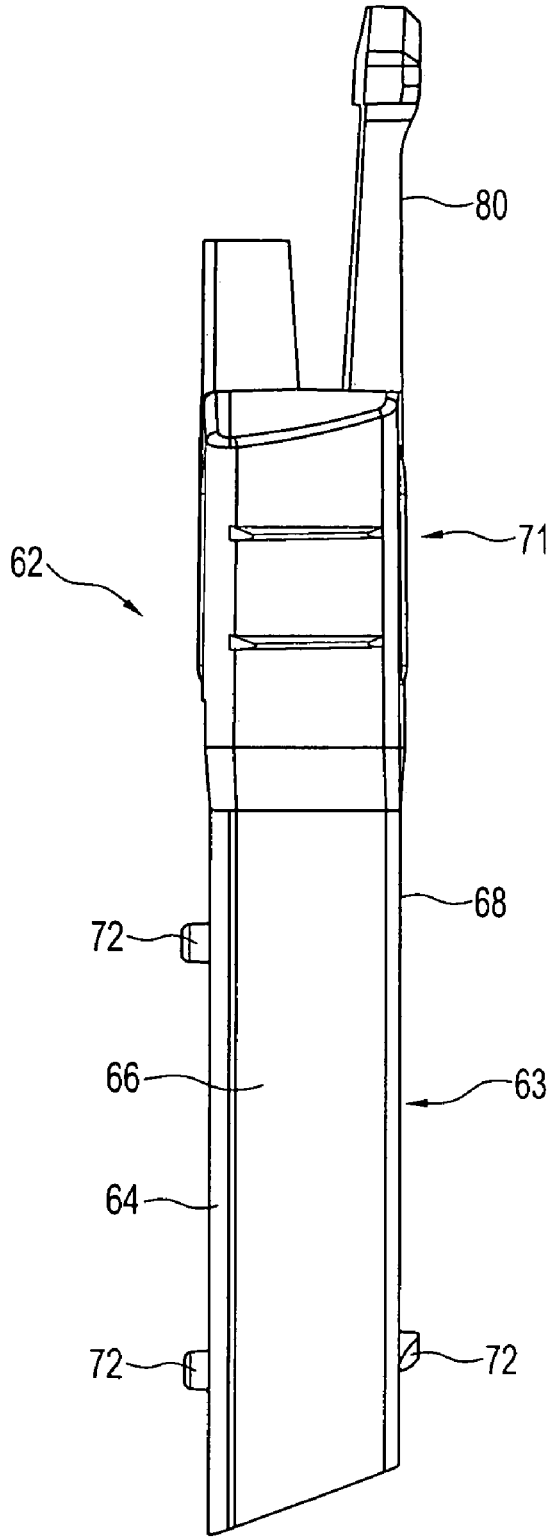
FIG. 10 is a side elevation view of the antenna base of FIG. 7.
Figure 11:
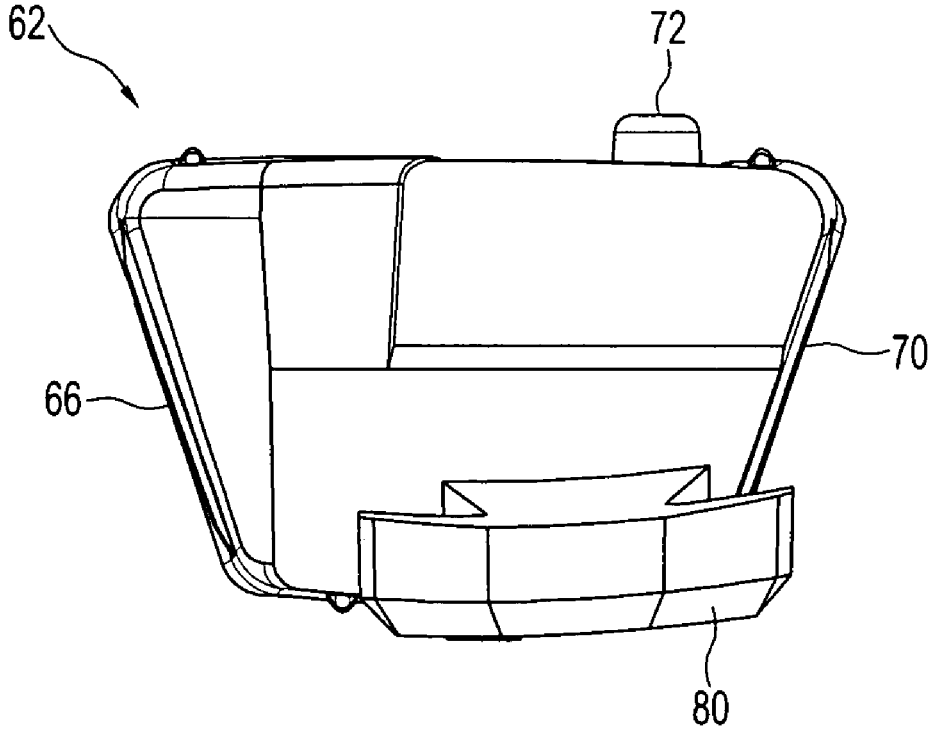
FIG. 11 is an end view of the antenna base of FIG. 7.

Referring now to FIG. 5, which illustrates the multiple band antenna 20 in an unfolded position (with the spring contact 42 removed for clarity), it is shown that the unfolded antenna generally defines a triangle. To provide improved reception across low frequency bands, the multiple band antenna 20 preferably defines a length L, as shown along a top edge 52 of the antenna, and particularly of the planar surface 24. The length L preferably is as great as is possible given the size and/or volume constraints of a particular portable device.

The top edge 52 makes an angle $\alpha$ with a diagonal edge 54 of the multiple band antenna 20. Together, in a preferred embodiment, the top edge 52 and the diagonal edge 54 define two sides of a generally right triangle. This angle $\alpha$, which is illustrated in FIG. 5 by extending the top edge 52 and the diagonal edge 54 to an outer point 53, should be as large as possible to maximize the bandwidth of the antenna 20. Thus, to increase bandwidth and low band reception, it is desirable to maximize both length L and angle $\alpha$. As opposed to a flex antenna, the multiple band antenna 20 itself provides frequency reception at its different parts, without respect to individual antenna traces. In other words, the entire antenna 20 provides reception. High band reception is provided by sharpness of the contact 42 of the antenna 20 and by resonance of the PCB. Though the multiple band antenna 20 as implemented could be shaped as an unfolded half-bowtie, the total area taken up by such an antenna would be significantly larger than often permitted for portable devices. Accordingly, the folded multiple band antenna typically is a more desirable approach for portable devices. Outer edges of planar surfaces 24, 26, 28, 30 are angled slightly, so that the volume enclosed by the folded antenna 20 is tapered downwardly, though this is not required.

To further increase bandwidth of the multiple band antenna 20, it is desired to maximize distance between the ends of the antenna. Particularly, in the antenna 20 shown in FIGS. 1–6, it is desired to separate the top edge 52 from the outer edge of the fourth planar surface 30. This is accomplished by, for example, increasing angle α. By contrast, decreasing a results in decreased bandwidth. In the exemplary multiple band antenna 20, the length L allows reception down to, e.g., the 800 MHz (GSM) frequency.

Figure 12:
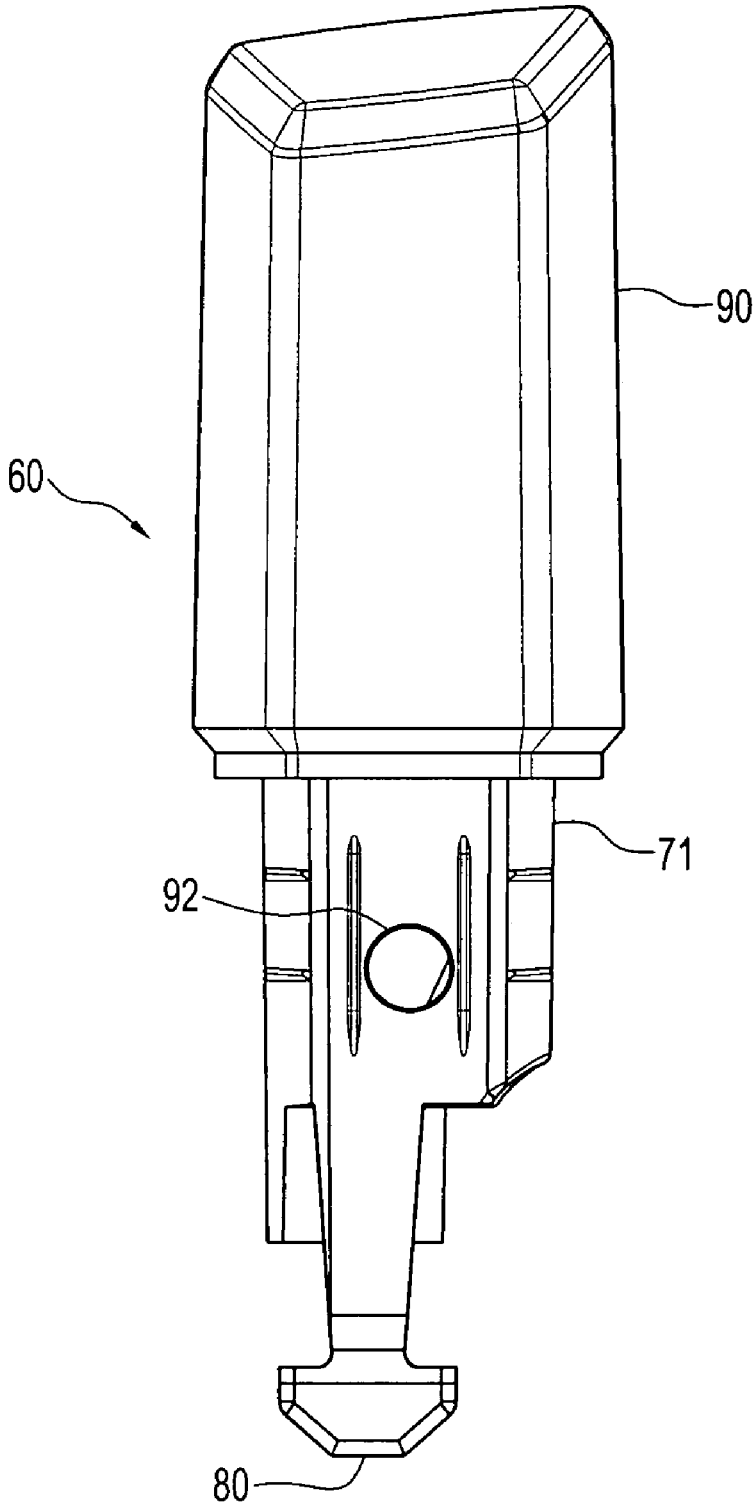
FIG. 12 is a top plan view of an antenna assembly, including the multiple band antenna of FIG. 1 and the antenna base of FIG. 7.
Figure 13:
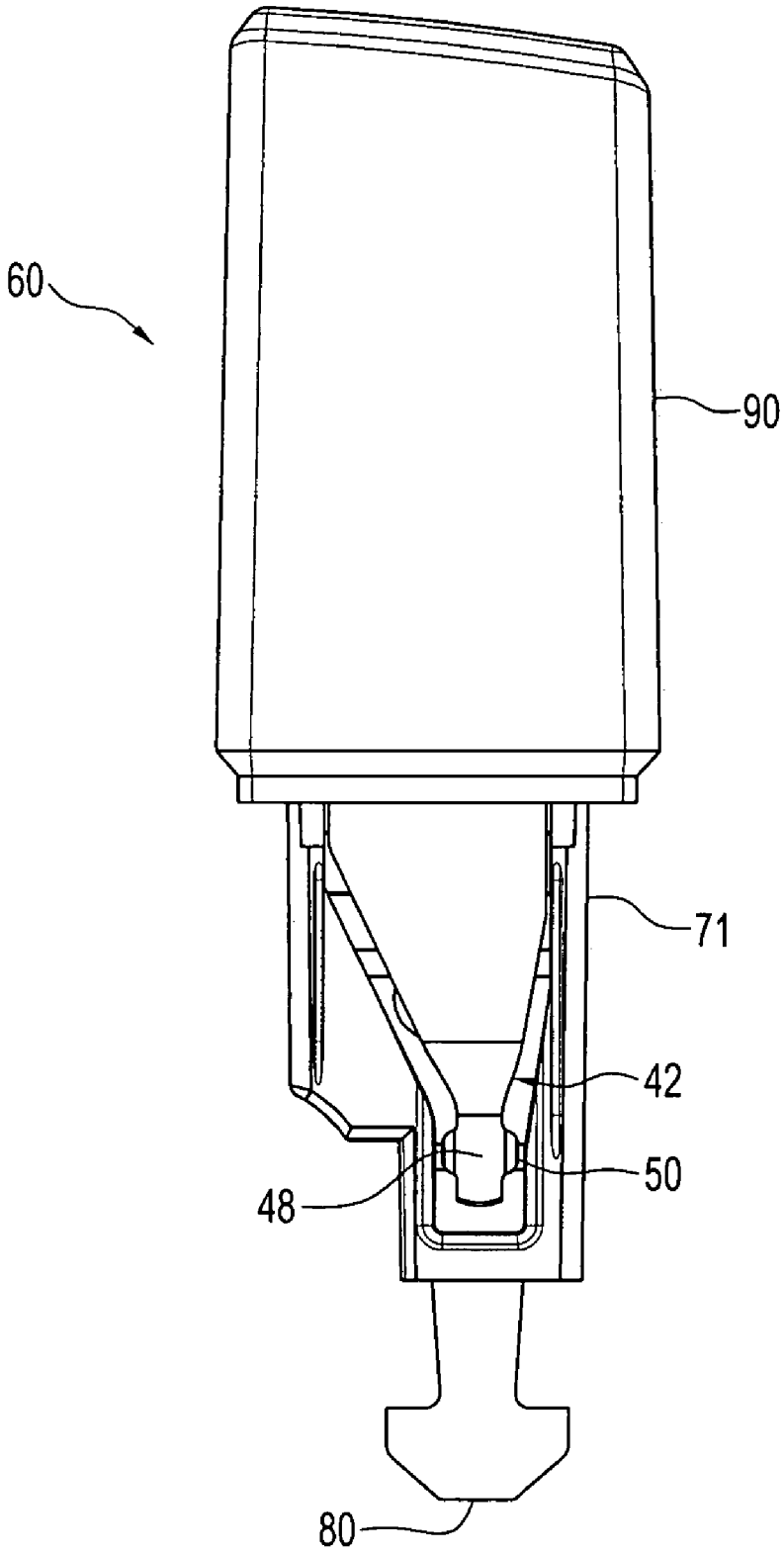
FIG. 13 is a bottom plan view of the antenna assembly of FIG. 12.
Figure 14:
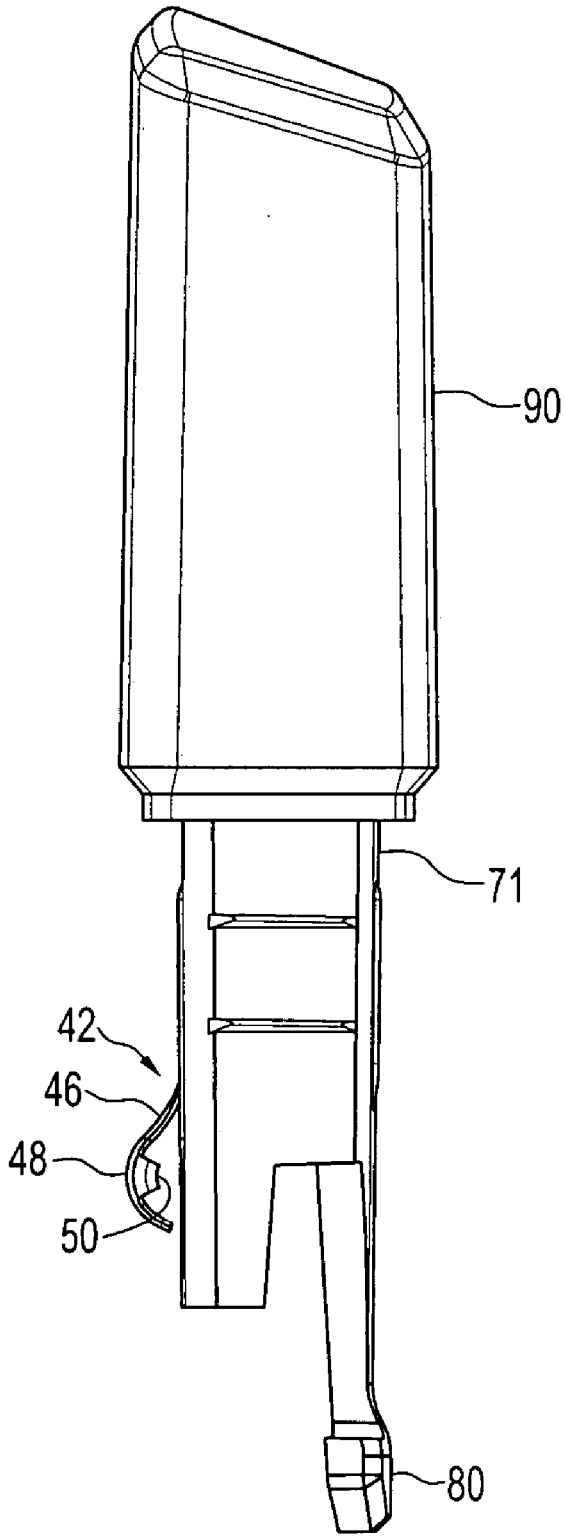
FIG. 14 is a side elevation view of the antenna assembly of FIG. 12.
Figure 15:
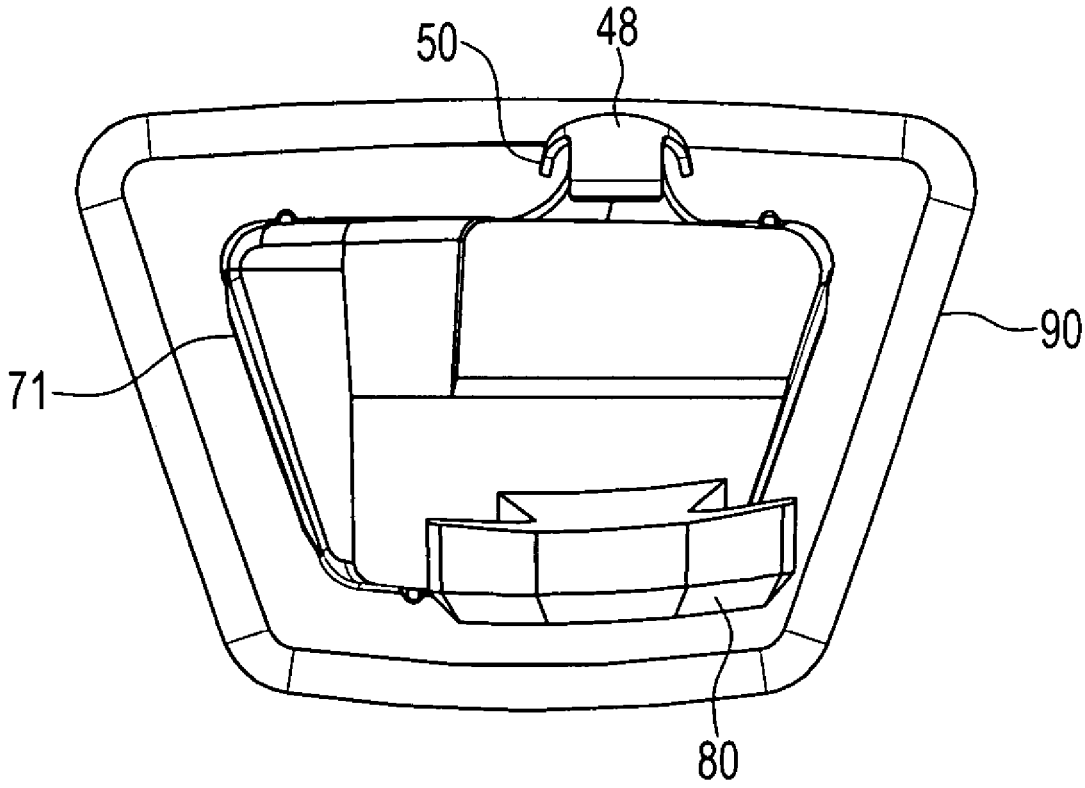
FIG. 15 is an end view of the antenna assembly of FIG. 12.

In a preferred embodiment of an antenna assembly 60 (see FIG. 12) for the portable device, the multiple band antenna 20 is wrapped around a base 62, which is mechanically connected to the portable device. The base 62, when covered with an overmold, generally resembles a stub extending outwardly from the portable device. As shown in FIGS. 7–11, the exemplary base 62, preferably made of a nonconductive material such as a plastic, includes an upper portion 63 with first, second, third, and fourth planar surfaces 64, 66, 68, 70 that respectively engage the first, second, third, and fourth planar surfaces 24, 26, 28, 30 of the antenna 20. For example, the first planar surface 64 of the base 62 is engaged with the first planar surface 24 of the multiple band antenna 20, as most clearly shown in FIG. 12. Preferably, the first planar surface 24 of the antenna 20 is dimensioned to cover as much of the first planar surface 64 of the base 62 as possible, as this allows both the length L and angle α to be maximized. Posts 72 projecting from the first planar surface 64 engage apertures 74 of the first planar surface 24 to help maintain the position of the multiple band antenna 20 about the base 62, particularly during overmolding.

The upper portion 63 extends outwardly from the portable device. A lower portion 71 typically is fitted into the casing of the portable device. The lower portion 71 further includes a seat 76 for accepting the spring contact 42, including a flexible, generally triangular area 78 extending from planar surface 24 (see FIG. 3). The seat 76 preferably has a sufficient depth allowing the contact 42 when flexed downwardly to fit at least partly into the seat, to allow the antenna assembly 60 to be inserted into the casing of the portable device more easily during assembly.

When the multiple band antenna 20 is wrapped about the base 62, it is preferred that the first, second, third, and fourth planar surfaces 24, 26, 28, 30 remain as close to the planar surfaces 64, 66, 68, 70 of the base 62 as is possible, with the exception of the arced surface 46 and rounded portion 48 of the spring contact 42. When incorporated into the mobile communication device, the rounded portion 48 principally engages the PCB to make electrical contact between the multiple band antenna 20 and the PCB. Preferably, as shown in FIG. 3, the tri angular area 78 is indented slightly inwardly on opposing sides from the first planar surface 24. This increases flexibility of the spring contact 42 and/or permits the lower portion 71 of the base 62 to be narrower than the upper portion 63.

The lower portion 71 of the base 62 further includes a retention device, such as a hook 80. The hook 80 engages, for example, a casing of the portable device for retaining the multiple band antenna 20 in position with respect to the PCB.

Often, in designing antennas for portable devices, mechanical constraints, such as height and volume of the overall antenna assembly 60, are imposed. The folded half-bowtie shape of the multiple band antenna 20 in combination with the preferably compact base 62 provides a device for relatively high bandwidth reception, while minimizing length and volume for the antenna assembly 60 and thus the overall device.

To make a connection, the spring contact 42 is electrically coupled to the PCB. The spring contact 42 deflects downwardly, particularly at the triangular area 78, when engaging the PCB, and thus becomes biased upwardly to maintain an electrical connection. This spring force, for example, may be 50 grams or greater to securely maintain such a mechanical and electrical contact. However, this spring force can vary. In a preferred embodiment, the spring contact engages a rigid C-shaped clip (C-clip) of the PCB. The flexibility of the spring contact 42 adjusts for tolerance between the C-clip and the spring contact.

Referring now to FIGS. 12–15, an overmold 90 is preferably formed about the top of the base 62, particularly the upper end 63 of the base 40 to protect the base and the antenna 20. Preferably, the region covered by the overmold 90 extends from the remainder of the portable device to provide what is generally known in the art as a stubby antenna. The overmold is preferably formed from a hard plastic that covers the multiple band antenna 20. The presence of the overmold 90 in the preferred material covering the folded multiple band antenna 20 does not appear to significantly decrease performance of multiple band reception from the device.

Figure 16:
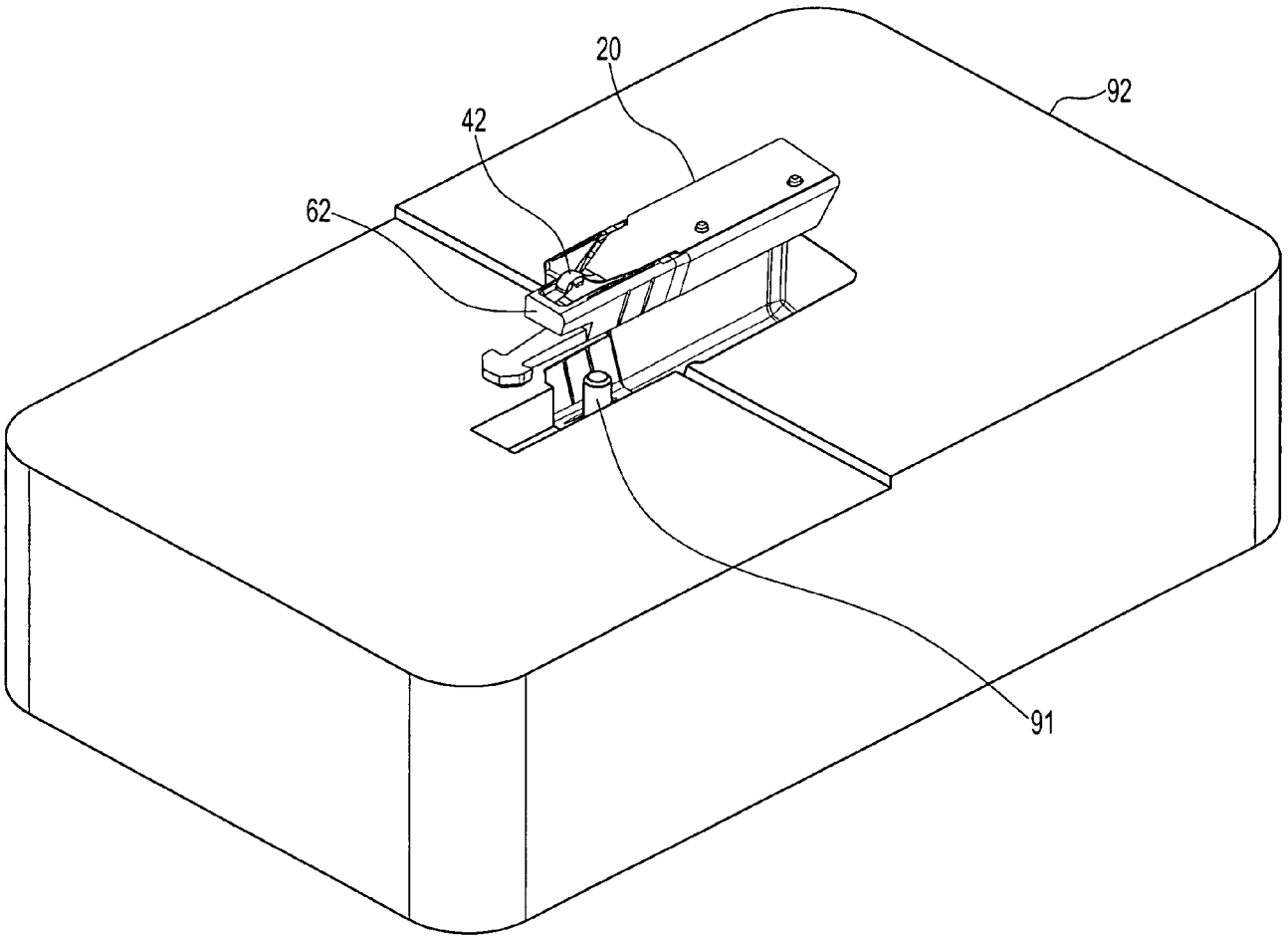
FIG. 16 is a perspective view of a mold for forming an overmold covering a portion of the base, according to a preferred embodiment of the present invention.

In forming the overmold 90 on the base 62 to cover the multiple band antenna 20, it is often difficult to maintain the position of the base 62 within a mold as the plastic material of the overmold is injected into the mold. Accordingly, the present inventors have discovered that it is useful to provide a pin extension 91 within a mold 92, as shown in FIG. 16, to maintain the position of the base 62 as the plastic is injected into the mold. Referring again to FIG. 12, for example, an aperture 93 may be formed into the base 62 to mate with the pin extension 91 of the mold 92. This helps secure the base 62, and thus keeps the base from undesirably shifting within the mold 92 as the overmold 90 material is forced into the mold to form the overmold.

The overmold 90 does not appear to significantly affect the overall response of the multiple band antenna 20, as opposed to a flex antenna. Furthermore, the present inventors have discovered that the half-bowtie preferred shape of the multiple band antenna 20 appears to provide much less radiation versus the ground plane. It appears that the ground plane exhibits far greater excitation in this arrangement than with a similar arrangement using a flex antenna. Thus, it appears that changing the shape of the multiple band antenna 20 to a certain degree has a relatively small effect on the overall performance of the multiple band antenna. However, as stated herein, both the angle α and the overall length L should be maximized to the extent possible to optimize reception of the multiple band antenna 20.

Figure 17A:
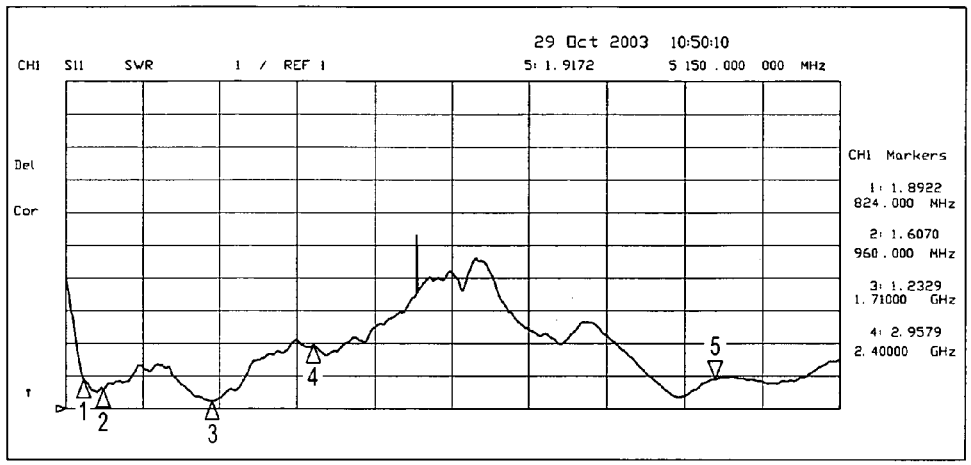
FIGS. 17A and 17B are graphs showing voltage standing wave ratio (VSWR) for a preferred multiple band antenna.
Figure 17B:
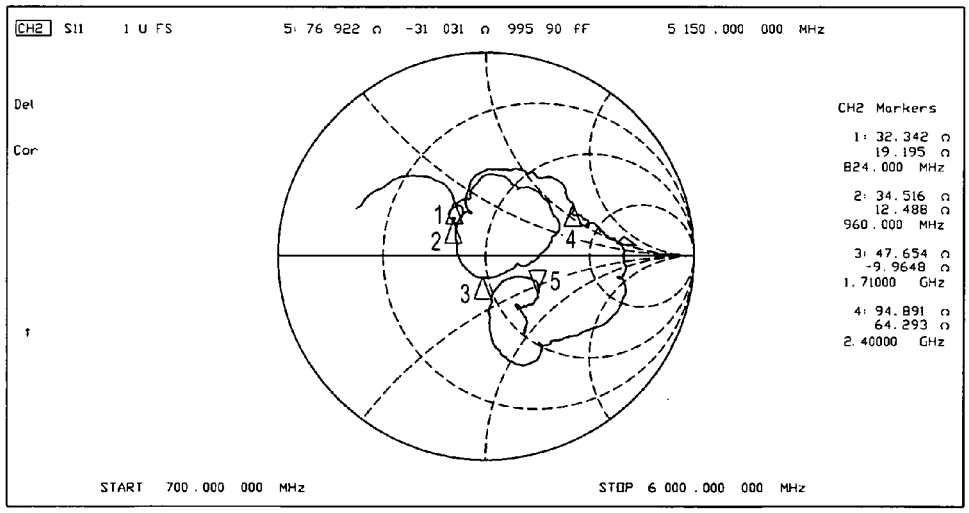

FIGS. 17A–17B are graphs showing a voltage standing wave ratio (VSWR) for an exemplary multiple band antenna 20. As shown, the exemplary multiple band antenna provides better than 3:1 VSWR across CDMA, GSM, GPS, DCS, PCS, 802.11g, and 802.11a bands.

While specific embodiments of the present invention have been shown and described, it should be understood that other modifications, substitutions, and alternatives are apparent to one of ordinary skill in the art. Such modifications, substitutions, and alternatives can be made without departing from the spirit and scope of the invention, which should be determined from the appended claims.

Various features of the present invention are set forth in the appended claims.

What is claimed is:

1. A multiple band antenna for mounting to a portable device, the antenna comprising:

a piece of conductive metal including a half-bowtie portion shaped to define a monopole and folded to provide a plurality of planar surfaces together generally enclosing a volume;

a flexible spring contact extending from the half-bowtie portion, the spring contact being configured for engaging a contact of the portable device.

2. The multiple band antenna of claim 1 wherein said piece of conductive metal comprises a metal plated with a conductive material.

3. The multiple band antenna of claim 2 wherein the metal comprises stainless steel.

4. The multiple band antenna of claim 2 wherein the conductive material comprises gold.

5. The multiple band antenna of claim 1 wherein the antenna is capable of reception across at least six bands.

6. The multiple band antenna of claim 5 wherein the antenna is capable of reception across at least the GSM, GPS, DCS, PCS, 802.11g, and 802.11b bands.

7. The multiple band antenna of claim 1 wherein the half-bowtie portion when unfolded defines a generally triangular shape having an elongated top edge and an elongated diagonal edge at an acute angle to the top edge.

8. The multiple band antenna of claim 7 wherein the half-bowtie portion when unfolded defines a generally right triangle.

9. The multiple band antenna of claim 1 wherein a portion of said piece of conductive metal is indented to add flexibility to said spring contact.

10. The multiple band antenna of claim 1 wherein said spring contact comprises a generally rounded surface at a distal end.

11. The multiple band antenna of claim 10 wherein the generally rounded surface is formed by crimping, and wherein the generally rounded surface forms a rounded portion at a peak.

12. For a portable device, an antenna assembly for providing reception in multiple bands comprising:

a piece of conductive metal including a half-bowtie portion shaped to define a monopole and a flexible spring contact extending from the half-bowtie portion;

a non-conductive base for supporting said piece of conductive metal and anchoring said piece of conductive metal to the portable device;

the half-bowtie portion being folded to provide a plurality of planar surfaces disposed generally orthogonally with respect to one another, the planar surfaces being disposed on planar surfaces of an upper portion of said base so as to substantially wrap around at least part of the upper portion of said base.

13. The antenna assembly of claim 12 further comprising:

a non-conductive overmold covering at least the half-bowtie portion and the upper portion of said base.

14. The antenna assembly of claim 12 wherein said base includes a lower portion for mechanically engaging the portable device and securing the antenna assembly to the portable device.

15. The antenna assembly of claim 14 wherein the spring contact extends over at least part of a seat disposed in the lower portion of said base.

16. The antenna assembly of claim 12 wherein the antenna assembly is capable of reception across at least the GSM, GPS, DCS, PCS, 802.11g, and 802.11b bands.

17. The antenna assembly of claim 12 wherein the half-bowtie portion when unfolded is defined by a generally triangular shape having an elongated top edge and an elongated diagonal edge at an acute angle to the top edge.

18. The antenna assembly of claim 13 wherein the overmold and the upper portion of said base form a stubby antenna.

19. The antenna assembly of claim 12 wherein the spring contact is configured to engage a contact of the portable device, and wherein the spring contact is coupled to circuitry of the portable device, the circuitry of the portable device providing a half-dipole.

20. For a portable device, an antenna assembly for providing reception in multiple bands comprising:

means for reception including a half-bowtie portion shaped to define a monopole and further including means for electrically coupling to circuitry of the portable device;

means for supporting said means for reception and anchoring said means for reception to the portable device;

the half-bowtie portion being folded about a portion of said means for supporting so as to substantially wrap around at least part of said means for supporting.

21. For a portable device, an antenna assembly for providing reception in multiple bands comprising:

a piece of conductive metal including a half-bowtie portion shaped to define a monopole and a flexible spring contact extending from the half-bowtie portion;

a non-conductive base for supporting said piece of conductive metal, said base comprising an upper portion having an outer surface, and a lower portion anchoring said base to the portable device;

the half-bowtie portion being substantially wrapped around the outer surface of the upper portion of said base.

* * * * *